US012588773B1

(12) United States Patent
Da Costa et al.

(10) Patent No.: US 12,588,773 B1
(45) Date of Patent: Mar. 31, 2026

(54) FITTED BED COVER WITH AN INTEGRATED TOP SHEET

(71) Applicants: Pedro Da Costa, Kissimmee, FL (US); Filipe Da Costa, Kissimmee, FL (US)

(72) Inventors: Pedro Da Costa, Kissimmee, FL (US); Filipe Da Costa, Kissimmee, FL (US)

( * ) Notice: Subject to any disclaimer, the term of this patent is extended or adjusted under 35 U.S.C. 154(b) by 89 days.

(21) Appl. No.: 18/640,221

(22) Filed: Apr. 19, 2024

(51) Int. Cl.
*A47G 9/02* (2006.01)

(52) U.S. Cl.
CPC ..... *A47G 9/0246* (2013.01)

(58) Field of Classification Search
CPC ..... A47G 9/0238; A47G 9/0246
See application file for complete search history.

(56) References Cited

U.S. PATENT DOCUMENTS 1,865,329 A * 6/1932 Mchorter ..... A47G 9/02 5/500
3,681,795 A * 8/1972 Palenske ..... A47G 9/02 5/497
4,777,677 A 10/1988 Dugan
5,729,847 A 3/1998 Allardice
6,061,851 A * 5/2000 Crowell ..... A47G 9/02 5/500
6,892,404 B2 * 5/2005 Harbin ..... A47G 9/0246 5/497
7,140,053 B1 * 11/2006 Mangano ..... A47G 9/02 5/493
8,997,280 B1 * 4/2015 Hannula ..... A47C 31/105 5/500
9,038,213 B2 * 5/2015 Cuneo ..... A47G 9/02 5/500
11,910,945 B1 * 2/2024 Connolly ..... A47G 9/0238
2004/0031098 A1 * 2/2004 Hollander ..... A47G 9/02 5/482
2007/0101496 A1 * 5/2007 Ho ..... A47G 9/02 5/482
2007/0113341 A1 * 5/2007 Ho ..... A47G 9/0238 5/497
2008/0115271 A1 * 5/2008 Wiley ..... A47G 9/02 5/482
2011/0302715 A1 * 12/2011 Battaglia ..... A47G 9/02 5/493
2011/0302716 A1 * 12/2011 Battaglia ..... A47G 9/02 5/493
2016/0058214 A1 * 3/2016 Preston ..... A47G 9/0238 5/497
2024/0041231 A1 * 2/2024 Preston ..... A47G 9/02

* cited by examiner

*Primary Examiner* — Eric J Kurilla
(74) *Attorney, Agent, or Firm* — Sanchelima & Associates, P.A.; Christian Sanchelima; Jesus Sanchelima

(57) ABSTRACT

A fitted bed cover with an integrated top sheet including a fitted cover assembly and a sheet assembly. The fitted cover assembly has four cover elastic corners and four cover portions. The sheet corner has two sheet elastic corners located at a bottom portion of the sheet. The sheet has a foot sheet portion that is sewed to a foot cover portion of the four cover portions. The four cover portions and the four cover elastic corners are configured to allow securing the fitted cover to a mattress. The sheet has a larger length than the fitted cover to include a head sheet portion that folds. The fitted cover with an integrated top sheet is made of linen.

1 Claim, 3 Drawing Sheets

FITTED BED COVER WITH AN INTEGRATED TOP SHEET

BACKGROUND OF THE INVENTION

1. Field of the Invention

The present invention relates to bed covers and, more particularly, to a bed cover with an integrated top sheet that has a bed linen with a fitted bottom sheet that has a fitted cover stitched to a top cover.

2. Description of the Related Art

Several designs for bed covers have been designed in the past. None of them, however, include a fitted bed cover with an integrated top sheet that has a top sheet and a fitted sheet having elastic corners and attached one to each other.

Applicant believes that a related reference corresponds to U.S. Pat. No. 5,729,847 issued for a Combination top and bottom bed sheet and method for constructing the same. The combination top and bottom sheet includes a top sheet and a bottom sheet. The top sheet is secured to the bottom sheet using a pinch seam formed in the bottom sheet such that a foot end terminal edge of the top sheet is sandwiched within the pinched seam. Further, foot corner notches are formed in the foot end of the bottom sheet. The formed fitted bottom sheet is provided with bottom panels designed to be inserted underneath corner portions of the underlying support. structure such as a mattress. The reference U.S. Pat. No. 5,729,847 does not teach of a top sheet having a pair of notches at the corners that matches with the notches of the fitted cover at the foot portion of the fitted cover. The top sheet further has elastic members at the bottom corners portions.

Applicant believes that another related reference corresponds to U.S. Pat. No. 4,777,677 issued for a mattress pad and fitted bed sheet for foldable sofa bed mattresses. The mattress pad and fitted bed sheet are formed by placing equal lengths and mattress pad material and bed sheet material in overlying relationship and sewing the narrower mattress pad material at its side edges to the sheet material. The reference U.S. Pat. No. 4,777,677 fails to teach of a fitted bed cover with an integrated top sheet that is comprised of an article of bed linen that includes a fitted bottom sheet with four elastic corner members that is combined with a top sheet which contains elastic members in the bottom two corner portions of the sheet.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a fitted bed cover with an integrated top sheet that has a fitted bed cover with four elastic corners that allow a better engagement and fit on commercial mattresses.

It is another object of this invention to provide a fitted cover with an integrated top sheet that has a top sheet with two elastic corners at the bottom thereof two be fit with the bottom corners of the fitted cover.

It is still another object of the present invention to provide a fitted cover with an integrated top sheet that has the top cover stitched to the fitted cover to allow making any kind of beds more efficiently.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
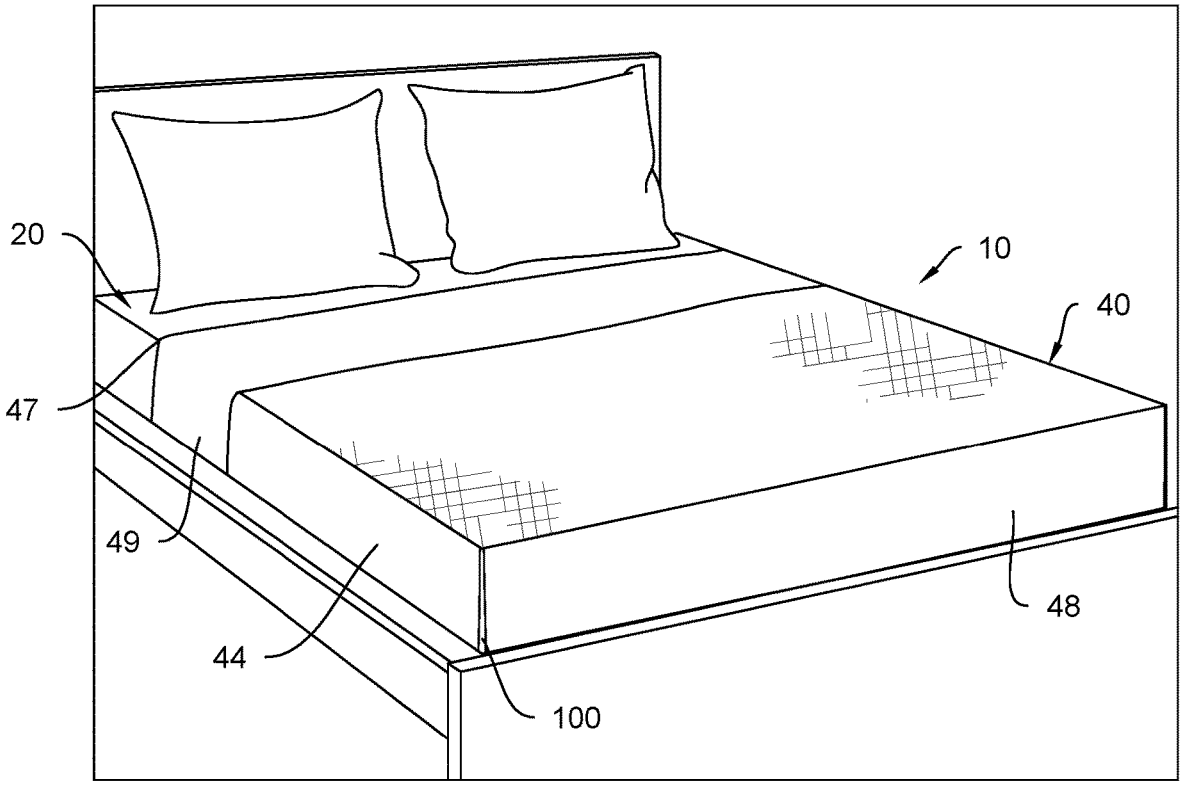
FIG. 1 represents an isometric operational view of the present invention 10 with the fitted cover assembly 20 and the sheet assembly 40 mounted on mattress 100.

Referring now to the drawings, where the present invention is generally referred to with numeral 10, it can be observed that it basically includes a fitted cover assembly 20 and a cover sheet assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The fitted cover assembly 20 is a fitted cover adapted to be secured to a mattress 100. The mattress 100 may be any suitable existing mattress in any commercial size. It should be understood that the fitted bed cover with an integrated top sheet may be manufactured in any suitable size for commercial mattresses. The fitted cover assembly 20 basically has an upper surface portion 22 and side skirt members that slide over the mattress sides. The fitted cover assembly 20 may have four elastic corners that assist with securely fitting the cover to the mattress 100. The fitted cover assembly 20 may be made of cotton, wool, polyester, vinyl, spandex, or any other known material for a fitted cover sheet. The upper surface portion 22 may be substantially rectangular in shape with two longer parallel sides and two shorter parallel sides perpendicular to the longer sides. One of the shorter sides corresponds to a head portion of the fitted cover, the second of the shorter sides corresponds to the foot portion of the fitted cover.

Figure 3:
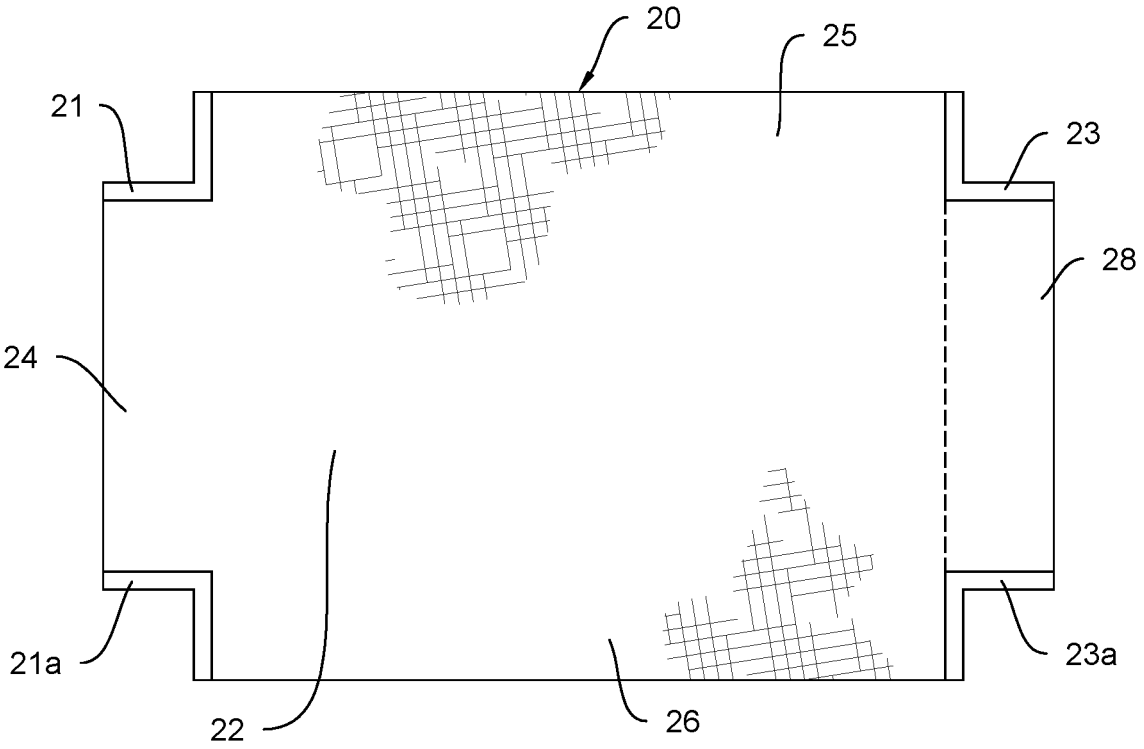
FIG. 3 illustrates an enlarged view of the fitted cover assembly 20.

In one of the preferred embodiments, the fitted cover assembly 20 may have four side skirt members as it can be observed in FIG. 3. A first skirt member 24 of the fitted cover assembly 20 may be located at one of the shorter sides of the upper surface portion 22. The first skirt member 24 may have a substantially rectangular shape. It also may be suitable to have the first skirt member 24 with other shapes such as but not limited to trapezoid shape, or any other suitable shape. The first skirt member 24 may be configured to cover the vertical side of one of the short sides of the mattress 100. The first skirt member 24 may have a substantially similar size as the short sides of the mattress 100.

A second skirt member 25 may be located at one of the larger sides of the upper surface portion 22. The second skirt member 25 may have a substantially rectangular shape. It also may be suitable to have the second skirt member 25 with other suitable shapes such as but not limited to a trapezoid shape. The second skirt member 25 may be configured to cover a lateral vertical side of the mattress 100. The second skirt member 25 may be larger in size than the first skirt member 24. The second skirt member 25 may be of the size of the lateral side of the mattress. A third skirt member 26 may be located on a second larger side of the upper surface portion 22 opposite to the second skirt member 25. The third skirt member 26 may have a substantially rectangular shape or any other suitable shape. The third skirt member 26 may be configured to cover a second lateral side of the mattress 100. The third skirt member 26 may have a similar size than the second skirt member 25.

A fourth skirt member 28 may be located on the second of the shorter sides of the super surface portion 22. The fourth skirt member 28 may have substantially the same size as the first skirt member 24. The fourth skirt member 28 may be rectangular in shape. The first skirt member 24, second skirt member 25, third skirt member 26, and fourth skirt member 28 may have a size that allows them to be fitted under the edges of the mattress bottom. The skirt members may be sewed to the upper surface portion 22 defining the fitted cover. The skirt members and the upper surface may be a unity sheet with notches in the corners to form the fitted cover.

The fitted cover assembly 20 may have four corner notches between the ends of each of the skirt members. The corner notches may be elastic corner members that allow to secure the fit cover assembly 20 to the mattress. A first elastic corner 21 may be located between the upper edge of the first skirt member 24 and the left edge of the second skirt member 25. A second elastic corner 21*a* may be located between the lower edge of the first skirt member 24 and the left edge of the third skirt member 26. A third elastic corner 23 may be located between an upper edge of the fourth skirt member 28 and a right edge of the second skirt member 25. A fourth elastic corner 23*a* may be located between a lower edge of the fourth skirt member and a right edge of the third skirt member 26. Each of the elastic corners may be attached to the fitted cover by sewing or the like.

Figure 4:
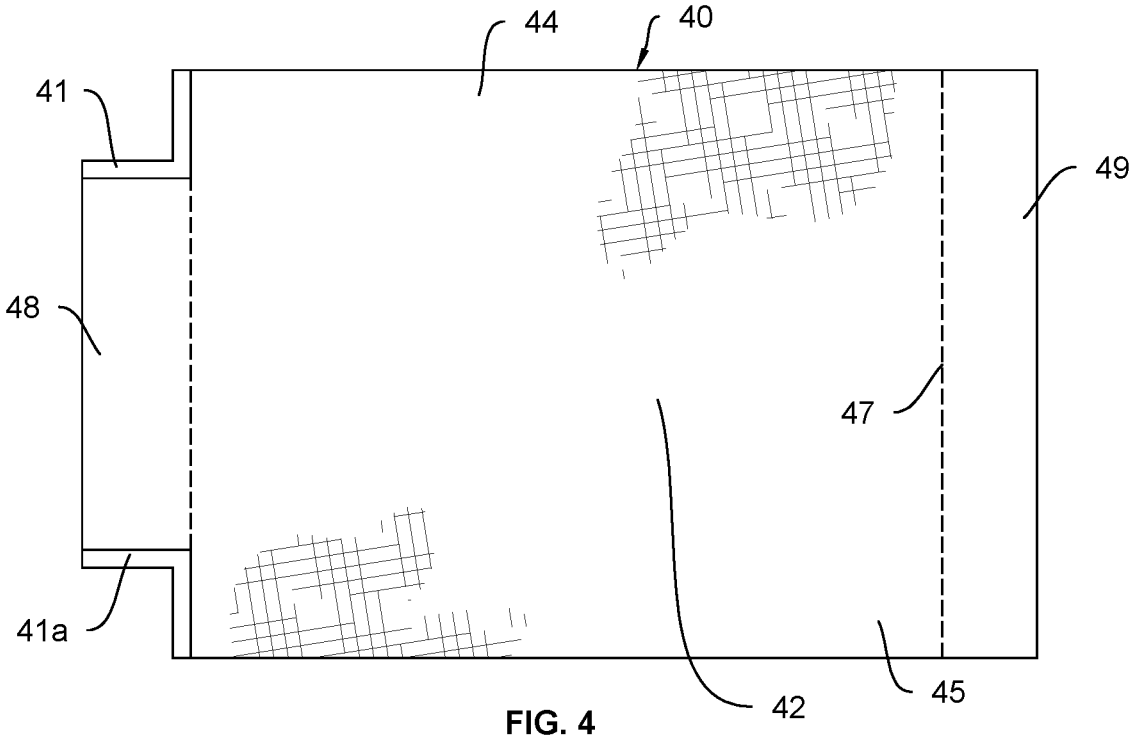
FIG. 4 is a representation of the sheet assembly 40.

Referring now to FIG. 4 it can be observed the sheet assembly 40. The sheet assembly 40 basically has a top sheet 42. The top sheet 42 may have a substantially rectangular shape. The top sheet 42 may be made of cotton, wool, polyester, or any other suitable material for a mattress sheet. The top sheet 42 may have a first sheet lateral portion 44 and a second sheet lateral portion 45 extending an entire length of the top sheet 42. The first sheet lateral portion 44 and the second sheet lateral portion 45 may be rectangular in shape. The sheet assembly 40 may further include a foot sheet portion 48 located at a bottom short edge of the top sheet 42. The sheet assembly 40 may include a first sheet corner 41 and a second sheet corner 41*a*. The first sheet corner 41 and the second sheet corner 41*a* may be elastic corners. The first sheet corner 41 may be located on an upper edge of the foot sheet portion 48 and the second sheet corner 41*a* may be located on a lower edge of the foot sheet portion 48. The sheet assembly 40 may have substantially the same width as the fitted cover assembly 20. The sheet assembly 40 may be larger than the fitted cover assembly 20. The sheet assembly 40 may have a crease 47 formed when the top sheet 42 is folded up forming a folded head sheet portion 49 as observed in FIG. 1.

Figure 2:
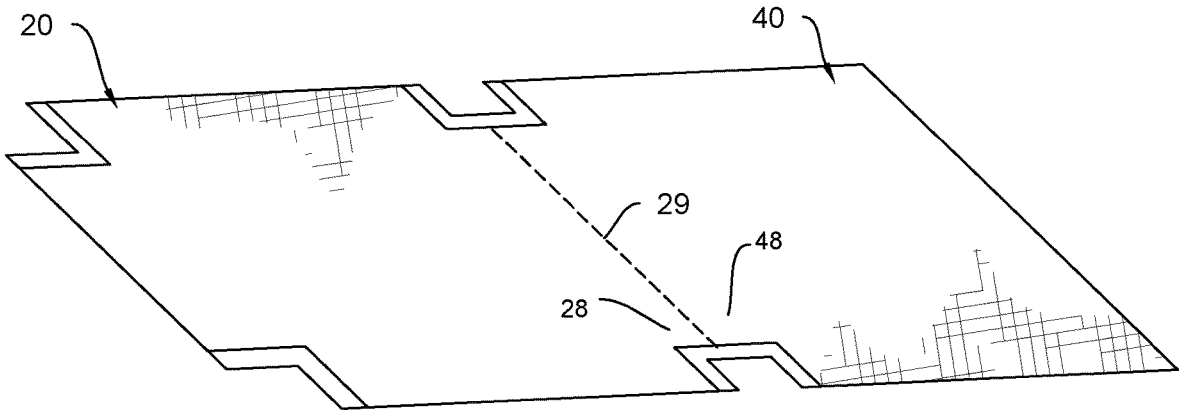
FIG. 2 shows an isometric view of the fitted cover assembly 20 sewed to the sheet assembly 40.

Best observed in FIG. 2, The sheet assembly 40 may be attached to the fitted cover assembly 20 using a seam 29 that connects the fourth skirt member 28 to the foot sheet portion 48. It should be understood that the sheet assembly 40 and the fitted cover assembly 20 may be connected using other attaching methods known in the prior art. The sheet assembly 40 combined with the fitted cover assembly 20 may allow to make beds easier and faster and to keep the bed organized. The fitted cover assembly 20 may be fitted to a mattress 100 with the four skirt members. The sheet assembly 40 integrated to the fitted cover assembly 20 may be folded to be disposed on top of the fitted cover assembly 20 keeping the mattress organized as observed in FIG. 1. The upper surface portion 22 may cover the top surface of the mattress 100 and the four skirt members may cover lateral sides of the mattress 100. In one particular embodiment, the fitted cover assembly 20 may have a width of 78 inches and a large of 89 inches, with the corners being square notches of 12 inches. The sheet assembly 40 may have a width of 78 inches and a large of 100 inches with the corner notches of 12 inches. It should be understood that the sheet assembly 40 and the fitted cover assembly 20 may have other sizes suitable for commercial mattresses of different sizes. It should be understood that the present invention relates only to the fitted bed cover with an integrated top sheet including the cover assembly 20 and the sheet assembly 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fitted bed cover with an integrated top sheet, consisting of:

a. a fitted cover assembly including a fitted cover with an upper surface and four skirt members extending from the edge of the upper surface, wherein the fitted cover assembly further includes four elastic corner members located adjacent to the four skirt members, said four elastic corner members are notches formed in the corners of the fitted cover, wherein said fitted cover is configured to be fitted to a mattress using the four elastic corner members, said four skirt members are configured to cover vertical sides of the mattress, said upper surface is configured to cover a top surface of the mattress; and b. a sheet assembly including a top sheet and a foot sheet portion attached to the top sheet, said foot sheet portion is attached to one of the four skirt members of the fitted cover assembly using a seam, said top sheet is configured to be on top of the fitted cover.

* * * * *